US010702733B2

(12) United States Patent
Mela

(10) Patent No.: US 10,702,733 B2
(45) Date of Patent: Jul. 7, 2020

(54) RESISTANCE HARNESS

(71) Applicant: Marika Mela, Dania Beach, FL (US)

(72) Inventor: Marika Mela, Dania Beach, FL (US)

( * ) Notice: Subject to any disclaimer, the term of this patent is extended or adjusted under 35 U.S.C. 154(b) by 86 days.

(21) Appl. No.: 16/021,832

(22) Filed: Jun. 28, 2018

(65) Prior Publication Data

US 2019/0001179 A1 Jan. 3, 2019

Related U.S. Application Data

(60) Provisional application No. 62/527,600, filed on Jun. 30, 2017.

(51) Int. Cl.

| | |
|---|---|
| ***A63B 21/00*** | (2006.01) |
| ***A63B 21/04*** | (2006.01) |
| ***A63B 21/28*** | (2006.01) |
| ***A63B 21/055*** | (2006.01) |
| ***A63B 23/04*** | (2006.01) |
| ***A63B 21/062*** | (2006.01) |
| ***A63B 21/002*** | (2006.01) |

(52) U.S. Cl.

CPC ..... *A63B 21/4001* (2015.10); *A63B 21/4005* (2015.10); *A63B 21/4007* (2015.10); *A63B 21/4009* (2015.10); *A63B 21/4025* (2015.10); *A63B 21/4043* (2015.10); *A63B 21/002* (2013.01); *A63B 21/00061* (2013.01); *A63B 21/00065* (2013.01); *A63B 21/00189* (2013.01); *A63B 21/04* (2013.01); *A63B 21/0442* (2013.01); *A63B 21/0552* (2013.01); *A63B 21/0557* (2013.01); *A63B 21/0628* (2015.10); *A63B 21/28* (2013.01); *A63B 23/047* (2013.01); *A63B 2208/0204* (2013.01)

(58) Field of Classification Search

CPC ..... A63B 21/4011; A63B 21/4005; A63B 21/4007; A63B 21/4009; A63B 21/04; A63B 21/0442; A47L 3/00; A62B 35/0006–0025; A47D 13/046; A47D 13/086

See application file for complete search history.

(56) References Cited

U.S. PATENT DOCUMENTS

| | | | | |
|---|---|---|---|---|
| 223,799 | A * | 1/1880 | Butler | A63B 21/4017 482/139 |
| 2,097,376 | A * | 10/1937 | Marshman | A63B 21/0004 482/124 |
| 5,080,191 | A | 1/1992 | Sanchez | |
| 6,551,221 | B1 | 4/2003 | Marco | |
| 2007/0083975 | A1* | 4/2007 | Senegal | A63B 21/0552 2/102 |
| 2011/0203531 | A1* | 8/2011 | Spinelli | A47D 13/086 119/770 |

FOREIGN PATENT DOCUMENTS

| | | |
|---|---|---|
| WO | WO2013166493 | 11/2013 |
| WO | WO2014131446 | 9/2014 |

* cited by examiner

*Primary Examiner* — Jennifer Robertson
(74) *Attorney, Agent, or Firm* — McHale & Slavin, P.A.

(57) ABSTRACT

A resistance harness that allows 360° of resistance around the body. The strap design allows rings to slide from anterior to posterior or medial to lateral. The rings enable concentric, eccentric, or isometric resistance. This sliding ability allows for resistance to be constant in one direction or changeable. As the ring slides under tension, the muscular recruitment needed to resist will change as the force angle of the ring slides and changes position around the body.

5 Claims, 10 Drawing Sheets

FRONT 104
114
116
146
150
144
Strap 1
120
LEFT SIDE 108
138
Strap 2
2"
136
VL 12" OL 15"
Strap 2
Strap 1
106
148
140
102
110
118
142
RIGHT SIDE
112
VL 4" OL 9"

Strap 6
Strap 6

2"
194
208
6" Hook
VL 12" OL 15"
164
178
VL 26" OL 30"
5" Hook
21" Loop
6" Loop
230
234
2"
212
213
216
190
186
232
Strap 1
7" Loop
158
Strap 5
9" Loop
206
VL 14" OL 18"
176
VL 18" OL 22"
182
7" Hook
9" Hook
154
Strap 3
2"
2"
Strap 4
Hook and Loop Sew On
Adhesive is sewn on to
Straps 3, 4, 5 & 6

RESISTANCE HARNESS

PRIORITY CLAIM

In accordance with 37 C.F.R. § 1.76, a claim of priority is included in an Application Data Sheet filed concurrently herewith. Accordingly, the present invention claims priority to U.S. Provisional Patent Application No. 62/527,600 entitled "RESISTANCE HARNESS", filed Jun. 30, 2017, the contents of which is incorporated herein by reference.

FIELD OF THE INVENTION

This invention is related to the field of muscle training and in particular, a resistance harness.

BACKGROUND OF THE INVENTION

The importance of muscle training is well known. Muscle training can be used to increase the strength, general fitness, or rehabilitate after an injury. Gymnasiums may have exercise machines using weights and pulleys but the size and expense of such devices can lead to non-use. Free weights are cumbersome, are difficult to store, and require many different weights to be effective. Known devices that use springs or elastic bands provide resistance to muscle contraction but can limit the muscles affected, or lack the ability to isolate muscles.

What is lacking in the art is a lightweight, portable device capable of use in muscle training for particular muscles.

SUMMARY OF THE INVENTION

Disclosed is a resistance harness that can be used for: Rehabilitation exercises to improve spinal stability, speed training, core strength, resistance training, football skill development, golf swing training, boxing/mma training, scapular specific training without gleno-humeral contribution, spinal erector training, abdominal training, sled/parachute/resistance band pulling, and resistance training for amputees.

An objective of the invention is to provide 360° of resistance around the body.

Another objective of the invention is to provide an additional strap which connects side o-rings in the front to allow missing degrees of resistance capability.

Another objective of the invention is to allow resistance attached to o-rings slide anterior to posterior to allow movement in multiple planes with continued resistance.

Still another objective of the invention is to enable progression/regression of force application via changeable moment arms.

An advantage of the invention is that one size fits most individuals due to multiple options for adjustment.

Another advantage of the invention is that the device enables the removal or addition of levels of straps for resistance; enables anterior/posterior/lateral/rotational resistance to fully train the spinal and core muscles in all planes of motion; training the musculature of the hip and scapula, and enables the recruitment of more or less muscular contribution without changing amount of resistance via the levels of attachment (increase or decrease of moment arm).

Still another advantage of the invention is that the device can have arm/thigh attachments to allow 360° of resistance for the humerus and thigh musculature.

Yet another advantage of the invention is that by dropping the device to a lower level on the hips, this allows for basic sled belt usage.

Still another advantage of the invention is that basic pieces are interchangeable so that if one piece breaks, you can order that piece and not a whole new harness.

Yet still another advantage of the invention is that it enables upper body amputees to apply resistance to their scapulas and torso without the need of arms or hands.

Other objectives and further advantages and benefits associated with this invention will be apparent to those skilled in the art from the description, examples and claims which follow.

DETAILED DESCRIPTION OF THE PREFERRED EMBODIMENT

Figure 1:
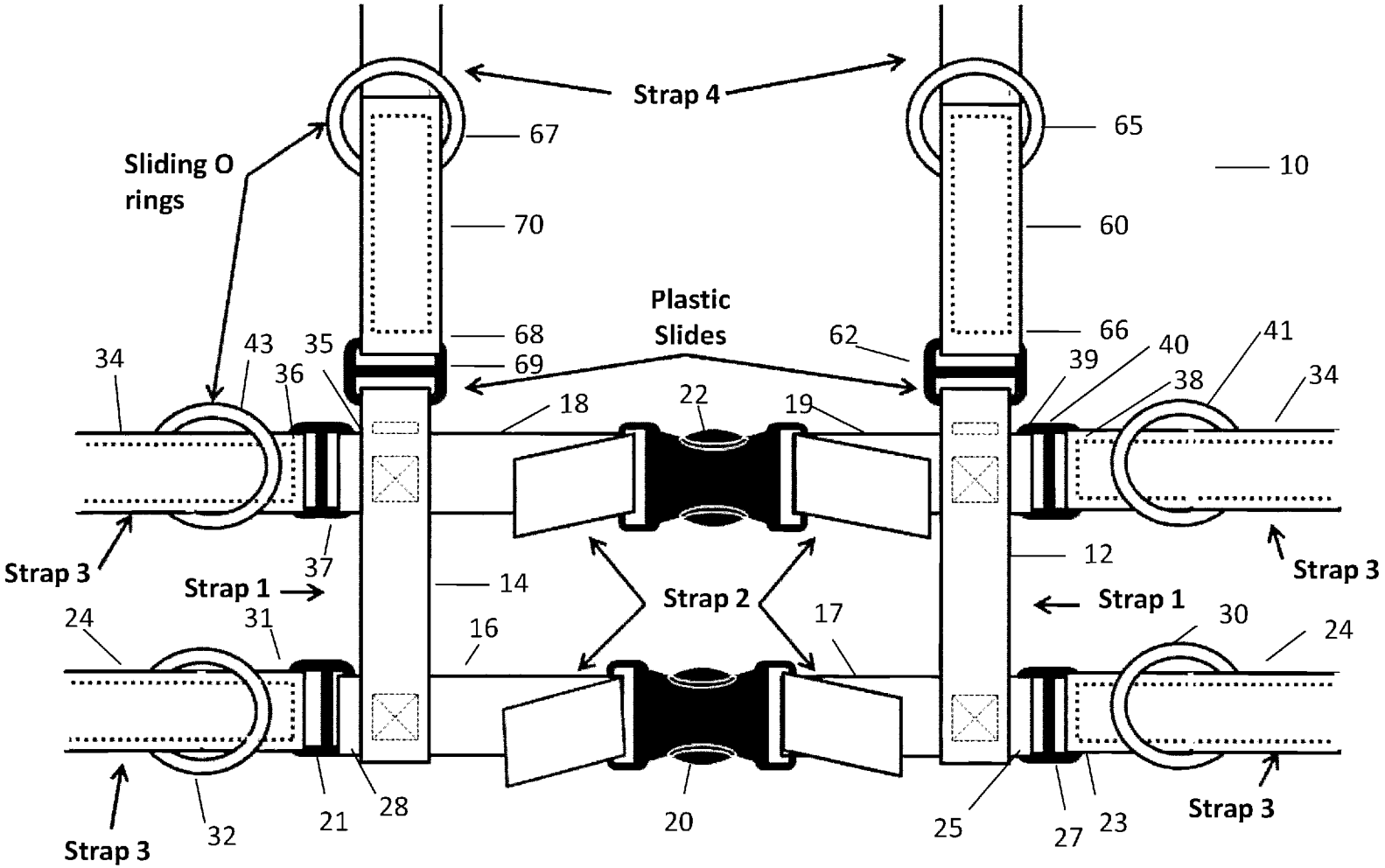
FIG. 1 is a plane front view of the basic harness of the instant invention.

Disclosed is a resistance harness that allows 360° of resistance around the body. The strap design allows the rings to slide from anterior to posterior or medial to lateral. The rings enable concentric, eccentric, or isometric resistance. This sliding ability allows for resistance to be constant in one direction or changeable. As the ring slides under tension, the muscular recruitment needed to resist will change as the force angle of the ring slides and changes position around the body.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Now referring to FIGS. 1-4, set forth is a resistance harness 10 defined by vertical support straps 12, 14 spaced apart by intermediate horizontally disposed straps 16 and secured together by adjustable snap 20; and horizontally disposed strap 18 and 19 secured together by adjustable snap 22. Snaps 20 and 22 allow for ease of installation and adjusting the spacing between vertical support straps 12 and 14.

First waist strap 24 having coupled to an end 28 of the horizontal waist strap 16 by buckle 21 at first end 31 and extending around the torso of an individual and terminating at a second end 23 which is coupled to horizontal waist strap 17 along end 25 by buckle 27. The first waist strap 24 having a first pull ring 30 positionable along strap 24 depicted near the end 23, and a second pull ring 32 depicted near end 28. The first waist strap 24 extends around the torso. A centrally disposed lower pull ring 29 is positioned around waist strap 24 spaced apart by vertical straps 60 and 70.

A second waist strap 34 has a first end 36 coupled to an end 35 of horizontally dispose strap 18 by buckle 37. An opposite end 38 of the second waist strap 34 is secured to strap along end 39 by buckle 40. The second waist strap 34 extending around the torso of an individual. The second waist strap 34 having a first pull ring 41 depicted near the end 38, and a second pull ring 43 depicted near end 36. The pull rings are able to slide along the length of each strap.

Figure 2:
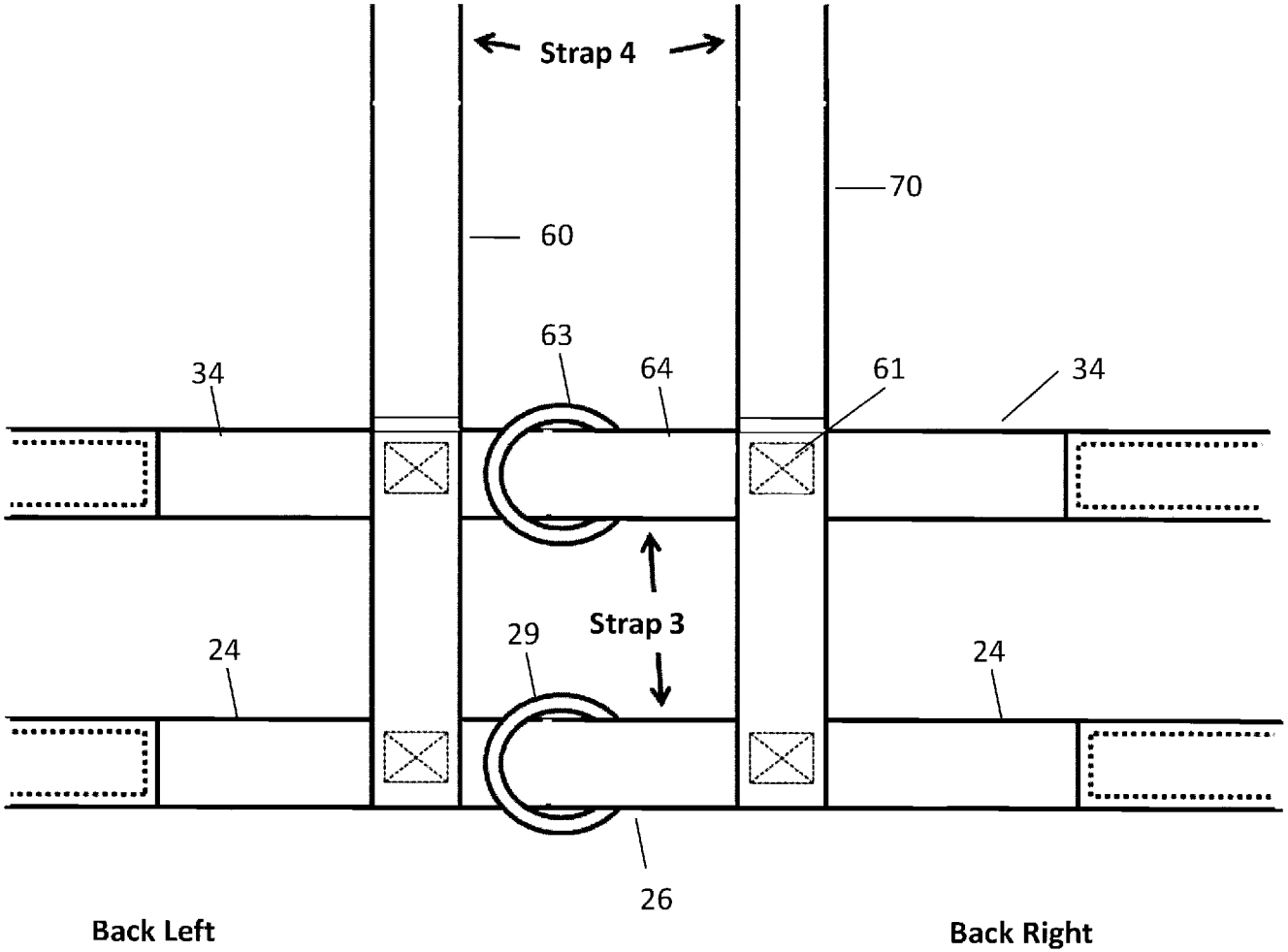
FIG. 2 is a back view thereof.
Figure 3:
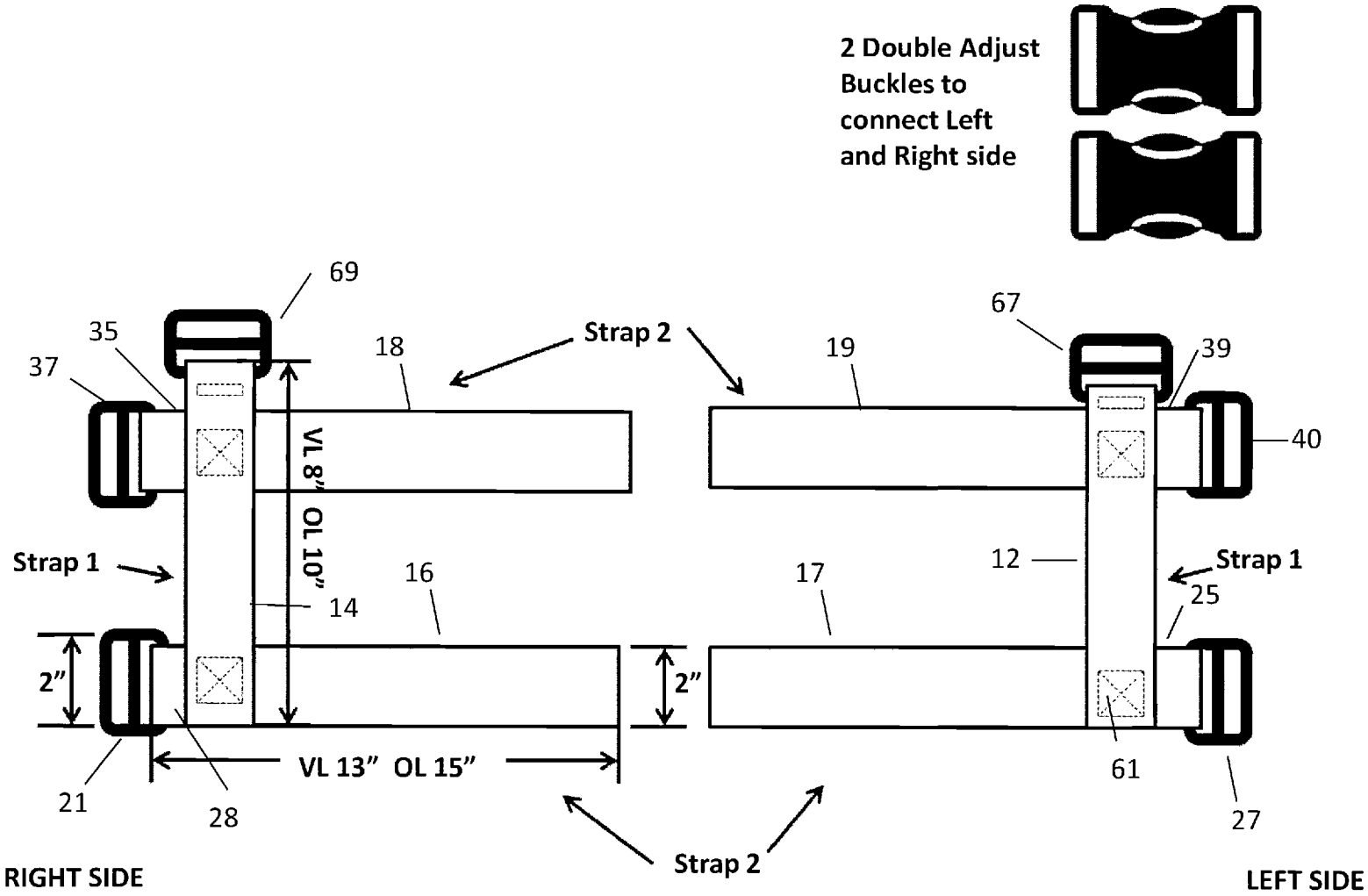
FIG. 3 is a plane view of straps 1 and 2 thereof.
Figure 4:
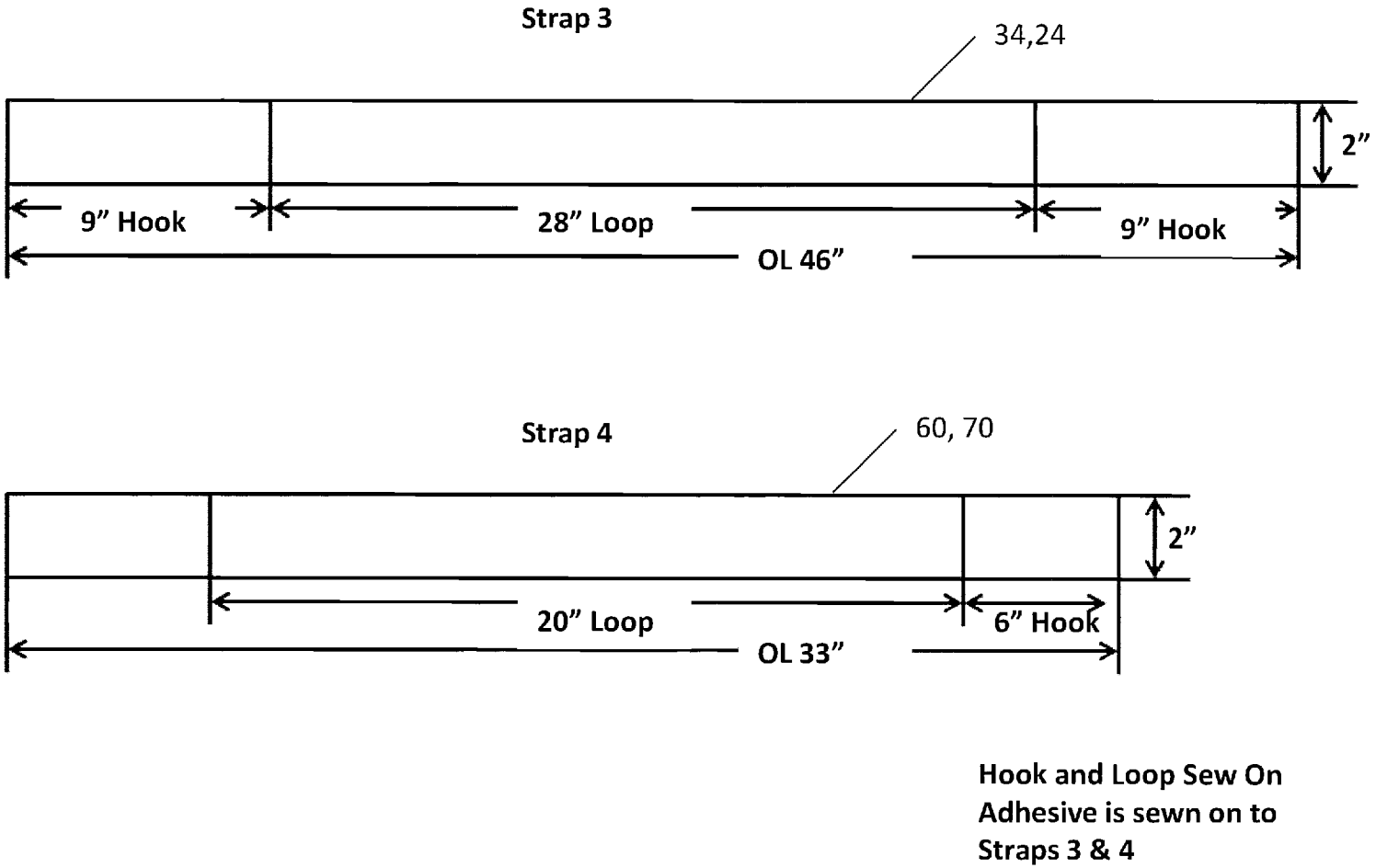
FIG. 4 is a plane view of straps 3 and 4 thereof.
Figure 5:
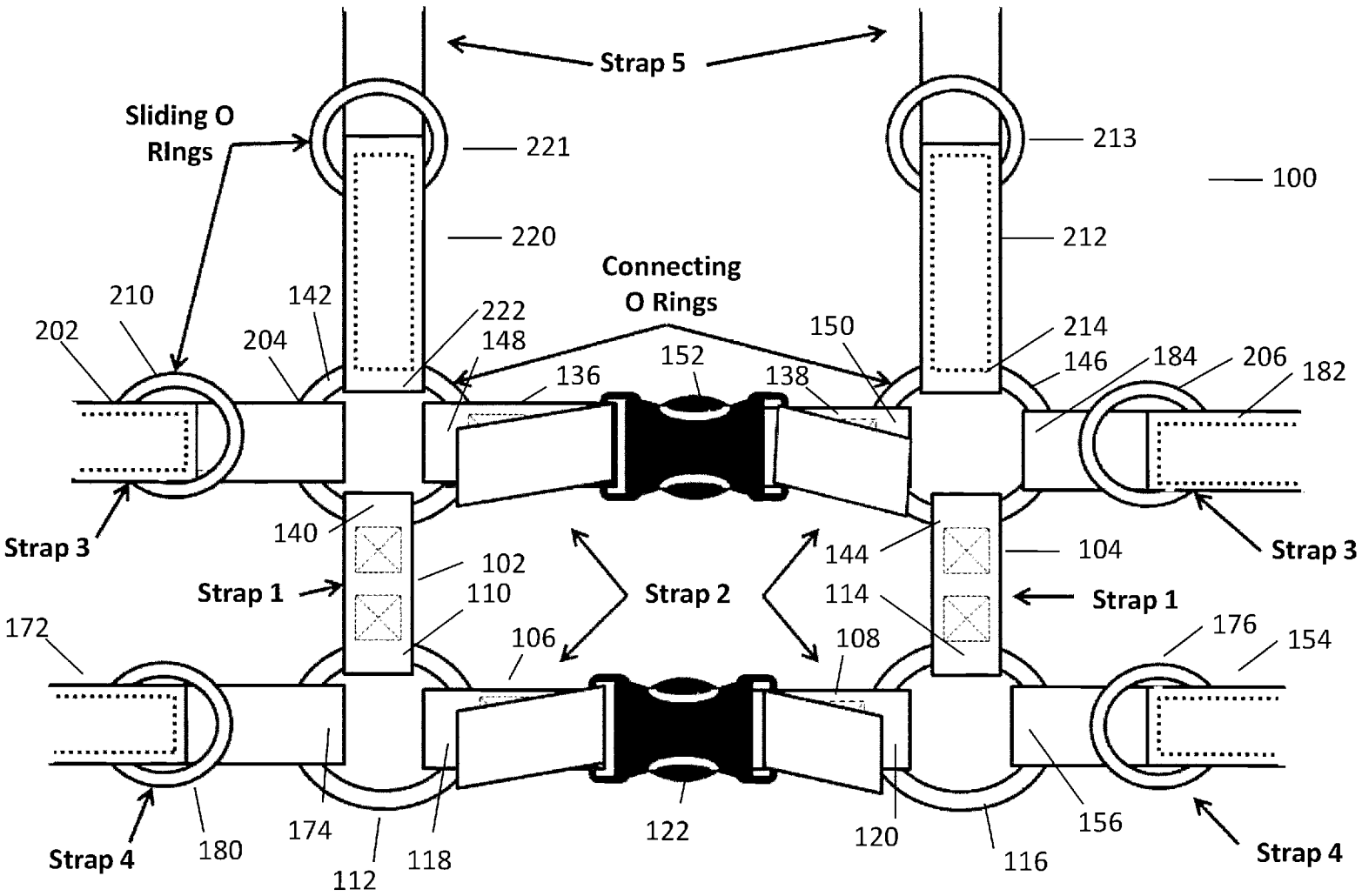
FIG. 5 is a plane front view of the heavy duty harness embodiment.
Figure 6:
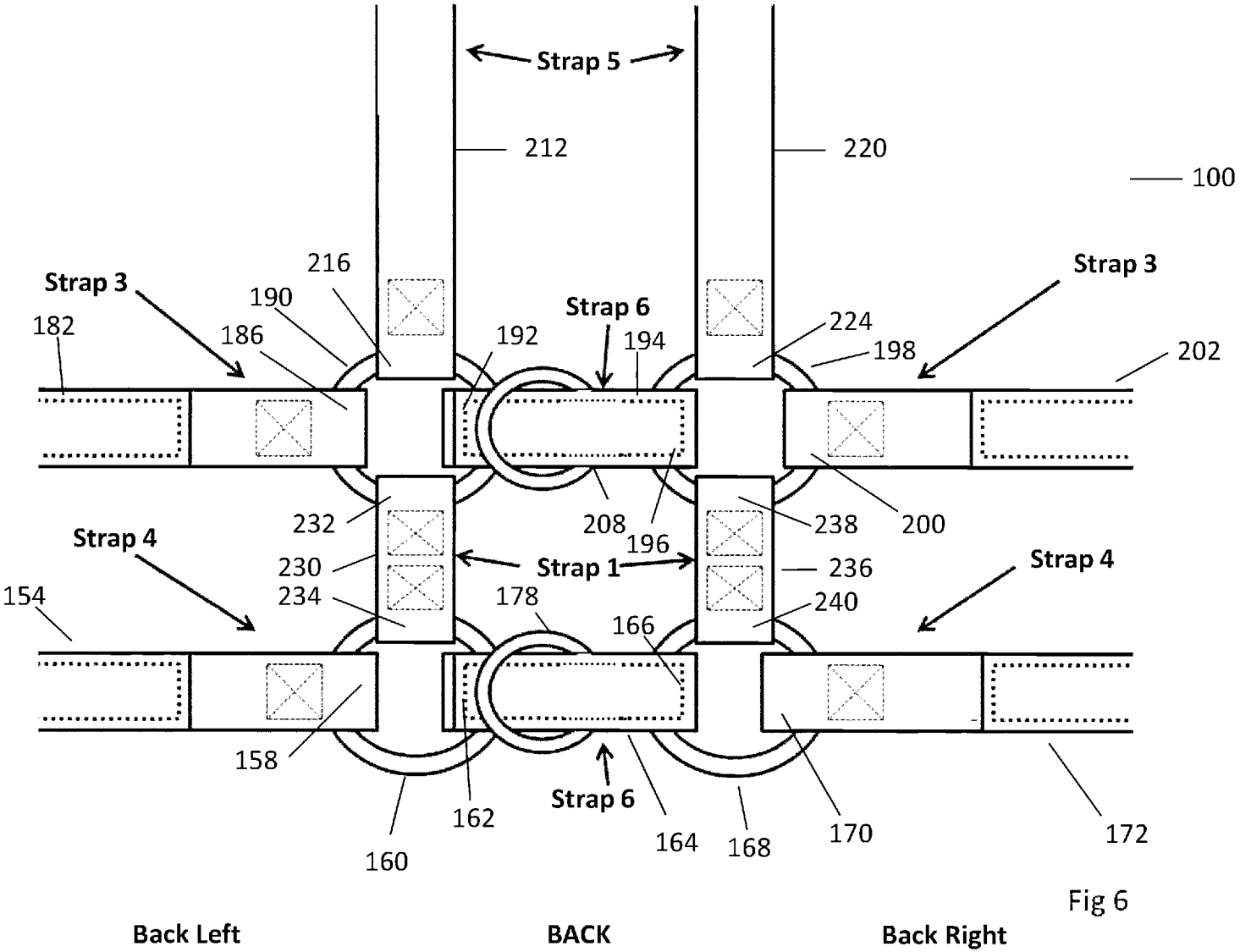
FIG. 6 is a back view thereof.
Figure 7:
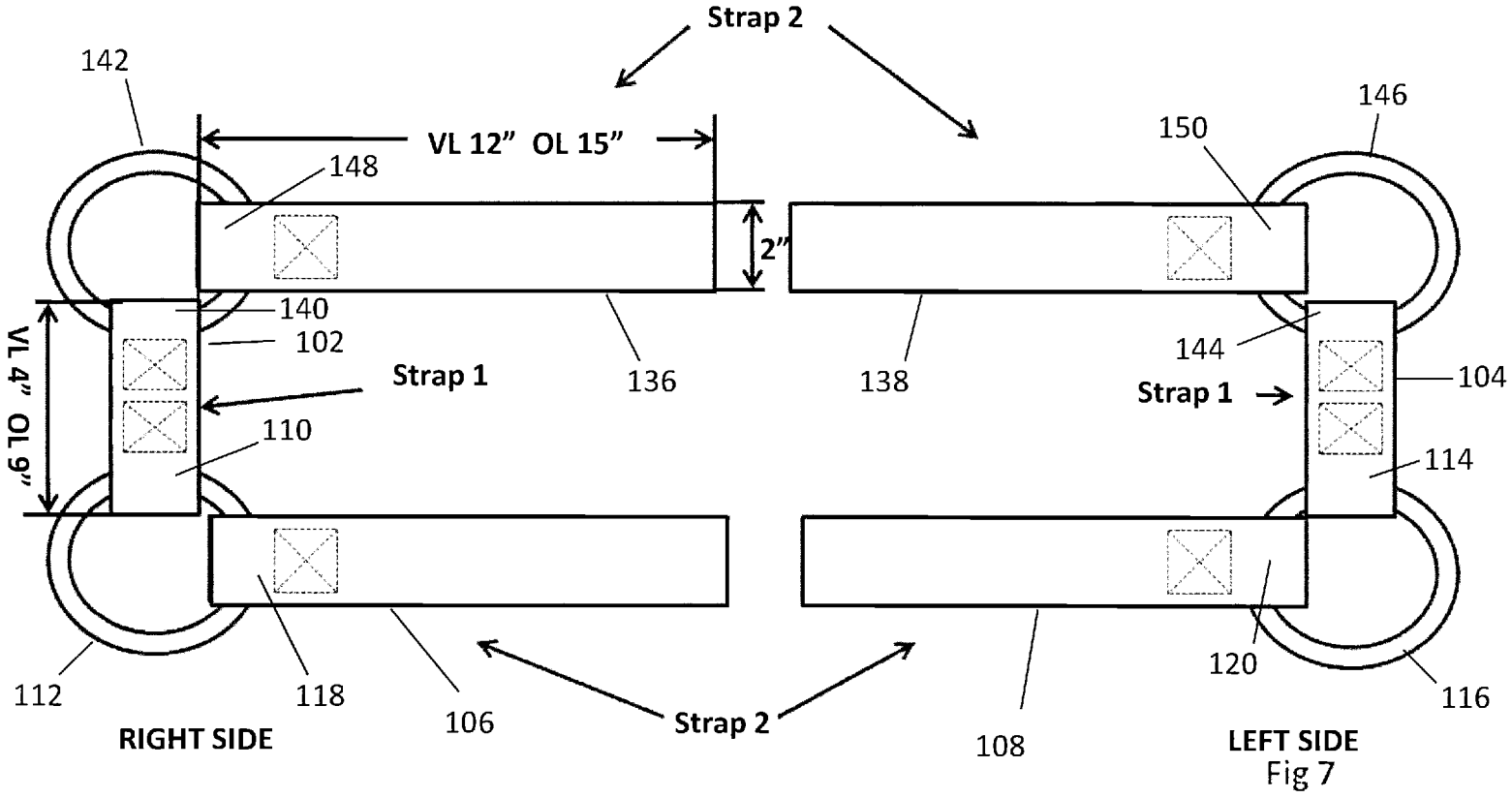
FIG. 7 is a plane view of straps 1 and 2 thereof.
Figure 8:
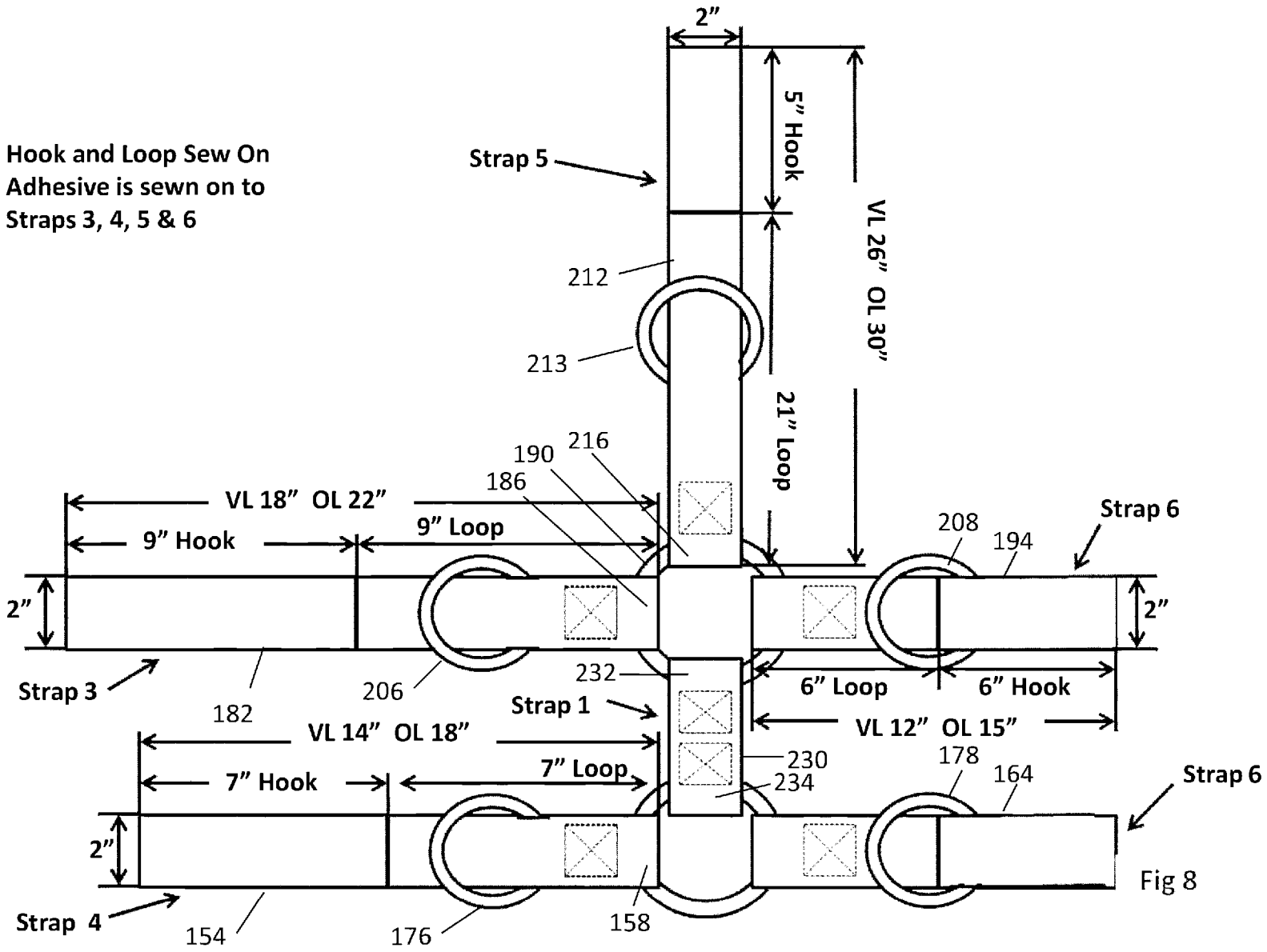
FIG. 8 is a back left side view thereof.
Figure 9:
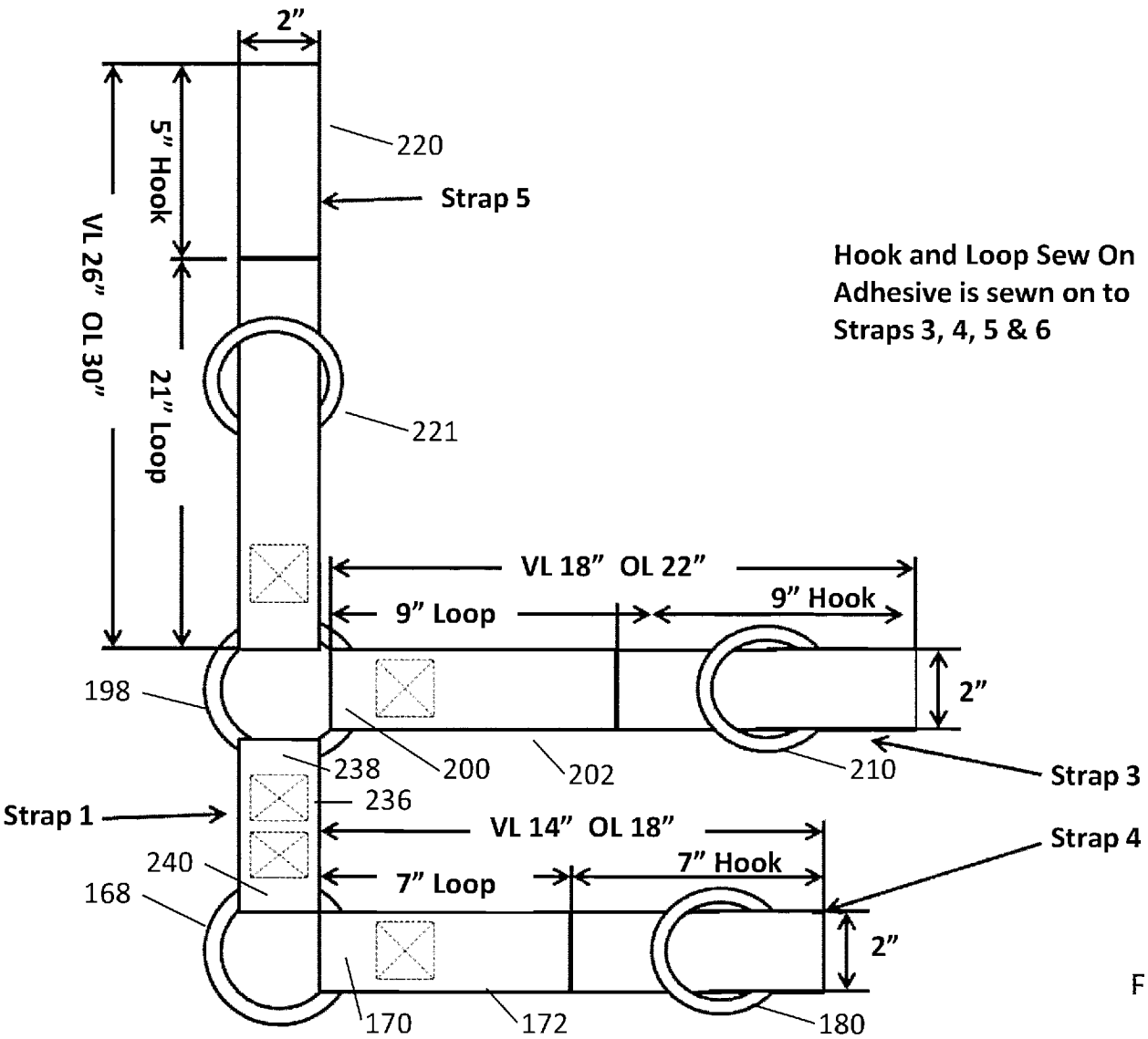
FIG. 9 is a back right side view thereof.

The second waist strap 34 extends around the torso and spaced apart by shoulder straps 60 and 70. The straps are constructed of a flexible material, such as nylon webbing with the spaced apart positioning exemplified by sewing along junctions. A centrally disposed upper pull ring 63 is positioned around the strap 34 between shoulder straps 60 and 70. In the preferred embodiment the shoulder straps 60 and 70 are sewn to the straps 24 and 34 providing spacing of straps as depicted in FIG. 2.

The first shoulder strap 60 extends from the vertical support strap 12 which positions the first and second horizontal straps 24, 34 in a spaced apart position along the front and rear of the torso. First shoulder strap 60 includes a frontal pull ring 65 positioned near the strap end 66 for buckle attachment 62 to the vertical tie strap 12.

A second shoulder strap 70 extends from vertical support strap 14 which positions the first and second horizontal straps 24, 34 in a spaced apart position along the front and rear of the torso. Second shoulder strap 70 includes a frontal pull ring 67 positioned near the strap end 68 for slidable positioning of the vertical strap 70. The strap end 68 coupled to the vertical strap 14 by buckle 69.

When Ring 65 or 67 is placed and pulled anteriorly it will create rotational force in the transverse plane and a flexion force in the sagittal plane of the body. The body will resist with counter rotation and extension. Muscles affected are the trunk rotators and extensors as well as scapular retractors, scapular elevators, hip rotators, hip extensors, knee extensors and ankle/foot muscular when standing, walking or running. The involvement of lower body musculature will depend on if the exerciser is seated, standing, walking or running.

Muscles involved with rotation and extension of the trunk:

Serratus Posterior—Superior/Inferior
Multifidus Lumborum
Multifidus Thoracis
Rotatores Lumborum
Rotatores Thoracis
Semispinalis Throacic
Quadratus Lumborum
Iliocostalis Lumborum
Iliocostalis Thoracis
Longissimus Lumborum
Longissimus Thoracis
Latissimus dorsi
Internal Oblique
Pyramidalis
Transvese Abdominis
Psoas major and minor
External Oblique
Rectus Abdominus
Interspinalis
Intertranversarii Muscles of the lower body involved to stabilize pelvic motions to allow trunk musculature to resist with rotational and/or extensor force when standing, seated, walking or running:

Gluteus maximus
Gluteus minimus
Gluteus medius
Adductor Maximus
Adductor brevis
Adductor longus
Pectineus
Gracilis
Semimembranosus
Semitendonosus
Biceps femoris
Rectus femoris
Vastus lateralis oblique
Vastus medialis oblique
Vastus intermedius
Tensor fascia latae
Iliacus
Obturator externus
Obturator internis
Quadrates femoris
Piriformis
Adductor minimus
Gastrocnemius
Soleus
Flexor hallucis logus
Flexor hallucis brevis
Flexor digitorum longus
Flexor digitorum brevis
Posterior tibialis
Quadratus Plantae
Peroneus longus
Plantar Interoseii Muscles of the shoulder girdle involved to stabilize or recruit scapular motion in retraction:

Trapezius muscle
Rhomboids
Levator scapula
Latissimus dorsi

When Ring 65, 67 is placed and pulled superiorly it will create lateral flexion force in the frontal plane of the body. The body will resist with counter lateral flexion of the trunk, downward rotation and depression of the scapula, and stabilization of the pelvis during sitting, standing or walking. The involvement of lower body musculature will depend on if the exerciser is seated, standing, or walking. Muscles involved with lateral trunk flexion:

Serratus Posterior—Superior/Inferior
Multifidus Lumborum
Multifidus Thoracis
Rotatores Lumborum
Rotatores Thoracis
Semispinalis Throacic
Quadratus Lumborum
Iliocostalis Lumborum
Iliocostalis Thoracis
Longissimus Lumborum
Longissimus Thoracis
Latissimus dorsi
Internal Oblique
Pyramidalis
Transvese Abdominis
Psoas major and minor
External Oblique Rectus Abdominus
Interspinalis
Intertranversarii Muscles involved with scapular downward rotation and depression:

Lower Trapezius muscle
Rhomboids
Levator scapula
Latissimus dorsi
Pectoralis minor
Pectoralis major
Serratus anterior
Sternal fibers of the sternocleidomastoid.

Muscles of the lower body involved with stabilization of the pelvis:

Gluteus maximus
Gluteus minimus
Gluteus medius
Adductor Maximus
Adductor brevis
Adductor longus
Pectineus
Gracilis
Semimembranosus
Semitendonosus
Biceps femoris
Rectus femoris
Vastus lateralis oblique
Vastus medialis oblique
Vastus intermedius
Tensor fascia latae
Piriformis
Adductor minimus
Peroneus longus
Peroneus brevis
Peroneus tertius
Extensor digitorum longus
Extensor digitorum brevis
Extensor hallucis longus
Extensor hallucis brevis When Ring 65, 67 is placed and pulled posteriorly it will create rotational force in the transverse plane and an extension force in the sagittal plane of the body. The body will resist with counter rotation and flexion. Muscles affected are the trunk rotators and flexors as well as scapular protractors, scapular elevators, hip rotators, hip flexors, knee flexors, and ankle/foot muscular when standing, walking or running. The involvement of lower body musculature will depend on if the exerciser is seated, standing, walking or running. Muscles involved with rotation and flexion of the trunk:

Serratus Posterior—Superior/Inferior
Multifidus Lumborum
Multifidus Thoracis
Rotatores Lumborum
Rotatores Thoracis
Semispinalis Throacic
Quadratus Lumborum
Iliocostalis Lumborum
Iliocostalis Thoracis
Longissimus Lumborum
Longissimus Thoracis
Latissimus dorsi
Internal Oblique
Pyramidalis
Transverse Abdominus
Psoas major and minor
External Oblique
Rectus Abdominus
Interspinalis
Intetranversarii Muscles of the lower body involved to stabilize pelvic motions to allow trunk musculature to resist with rotational and/or flexion force when standing, seated, walking or running:

Gluteus maximus
Gluteus minimus
Gluteus medius
Adductor Maximus
Adductor brevis
Adductor longus
Pectineus
Gracilis
Semimembranosus
Semitendonosus
Biceps femoris
Rectus femoris
Vastus lateralis oblique
Vastus medialis oblique
Vastus intermedius
Tensor fascia latae
Iliacus
Obturator externus
Obturator internis
Quadrates femoris
Piriformis
Adductor minimus
Gastrocnemius
Soleus
Flexor hallucis longus
Flexor hallucis brevis
Flexor digitorum longus
Flexor digitorum brevis
Posterior tibialis
Quadratus Plantae
Peroneus longus
Plantar Interoseii Muscles of the shoulder girdle involved with protraction and elevation:

Trapezius muscle
Serratus anterior
Pectoralis major
Pectoralis minor
Subclavius

Ring 43 and 41 have the same muscular recruitment to 65/67' when placed and pulled anteriorly or posteriorly. Muscular involvement in extension or flexion may slightly diminish from having reduced torque in the sagittal plane due to reduction in the moment arm of force application to the inferior joints axes. There is possibly a slight increase in muscle involvement in resisted rotation due to the slight increase in the torque in the transverse plane from the slight increase in moment arm since 41, 43 are slightly lateral to the position of 65, 67. Muscular recruitment will be the same as those listed under that provided when using Ring 65, 67/Strap 60, 70 Anterior.

Ring 41, 43/Strap 34 Inferior. When Ring 41, 43 is placed and pulled inferiorly it will create depressive force on the scapula and a slight lateral flexion force in the frontal plane of the body. If the ring is pulled inferior and anterior, it will create depression and protraction of the scapula. If the ring is pulled inferior and posterior, it will create depression and retraction of the scapula. The body will resist with counter lateral flexion of the trunk, upward rotation and either retraction/protraction of the scapula, and stabilization of the pelvis during sitting, standing or walking. The involvement of lower body musculature will depend on if the exerciser is seated, standing, or walking. Muscles involved with lateral trunk flexion and pelvic stabilization will be the same as that provided when using Ring 65, 67/Strap 60, 70 Superior, regarding muscles involved with lateral trunk flexion and muscles of the lower body involve with stabilization of the pelvis.

Muscles involved with scapular upward rotation, elevation, protraction and retraction:

Trapezius muscle
Levator scapula
Serratus anterior
Sternocleidomastoid
Omohyoid
Subclavius
Pectoralis major
Pectoralis minor
Rhomboids
Latissimus dorsi
Sternocleidomastoid Ring 41, 43/Strap 34 Superior. When Ring 41, 43 is placed and pulled superiorly it will create an elevation force on the scapula and a slight lateral flexion force in the frontal plane of the body. If the ring is pulled superior and anterior, it will create elevation and protraction of the scapula. If the ring is pulled superior and posterior, it will create elevation and retraction of the scapula. The body will resist with counter lateral flexion of the trunk, downward rotation and either retraction/protraction of the scapula, and stabilization of the pelvis during sitting, standing or walking. The involvement of lower body musculature will depend on if the exerciser is seated, standing, or walking. Muscles involved with lateral trunk flexion and pelvic stabilization will be the same as those listed under Ring 65, 67/Strap 60, 70 Superior regarding muscles involved with lateral trunk flexion and muscles of the lower body involve with stabilization of the pelvis.

Muscles involved with scapular downward rotation, depression, protraction and retraction:

Trapezius muscle
Levator scapula
Serratus anterior
Sternocleidomastoid
Omohyoid
Subclavius
Pectoralis major
Pectoralis minor
Rhomboids
Latissimus dorsi
Sternocleidomastoid Now referring to FIGS. 1 and 2, set forth is a muscular recruitment for Ring 41, 43/Strap 34—Lateral. When Ring 41, 43 is placed and pulled laterally it will create a slight depressive on the scapula and a lateral flexion force in the frontal plane of the body. The body will resist with counter lateral flexion of the trunk and upward rotation/elevation of the scapula. As the ring is pulled anterior or posterior, that is when the forces change into more of a rotational and flexion or extension force.

Muscles involved with lateral trunk flexion are the same as those listed under Ring 65, 67/Strap 60, 70 Superior.

Muscles of the lower body involved with stabilization of the pelvis are the same as those listed under Ring 65, 67/Strap 60, 70 Superior.

Muscles involved with elevation and upward rotation of the scapula: are the same as those listed under Ring 65, 67/Strap 60, 70 Posterior.

Ring 30, 32/Strap 24—Anterior, posterior, lateral, superior and inferior (FIG. 1, 2). Ring 30, 32 will have the same muscular recruitment of the trunk muscles as Ring 41, 43 with the exception of no direct scapular resistance and reduced moment arm in the sagittal plane. The ring is placed inferiorly to the scapula and is unable to apply a force through the scapula for scapular muscles to directly resist.

Muscles involved with lateral trunk flexion are the same as those listed under Ring 65, 67/Strap 60, 70—Superior.

Muscles of the lower body involved with stabilization of the pelvis are the same as those listed under Ring 65,67/Strap 60, 70—Superior.

Muscles involved with rotation and flexion of the trunk are the same as those listed under Ring 65, 67/Strap 60, 70—posterior.

Muscles involved with rotation and extension of the trunk are the same as those listed under Ring 65, 67/Strap 60, 70—Anterior.

Muscles involved with rotation and extension of the trunk are the same as those listed under Ring 65, 67/Strap 60-70—Anterior and Ring 65, 67/Strap 60, 70—Superior.

Figure 10:
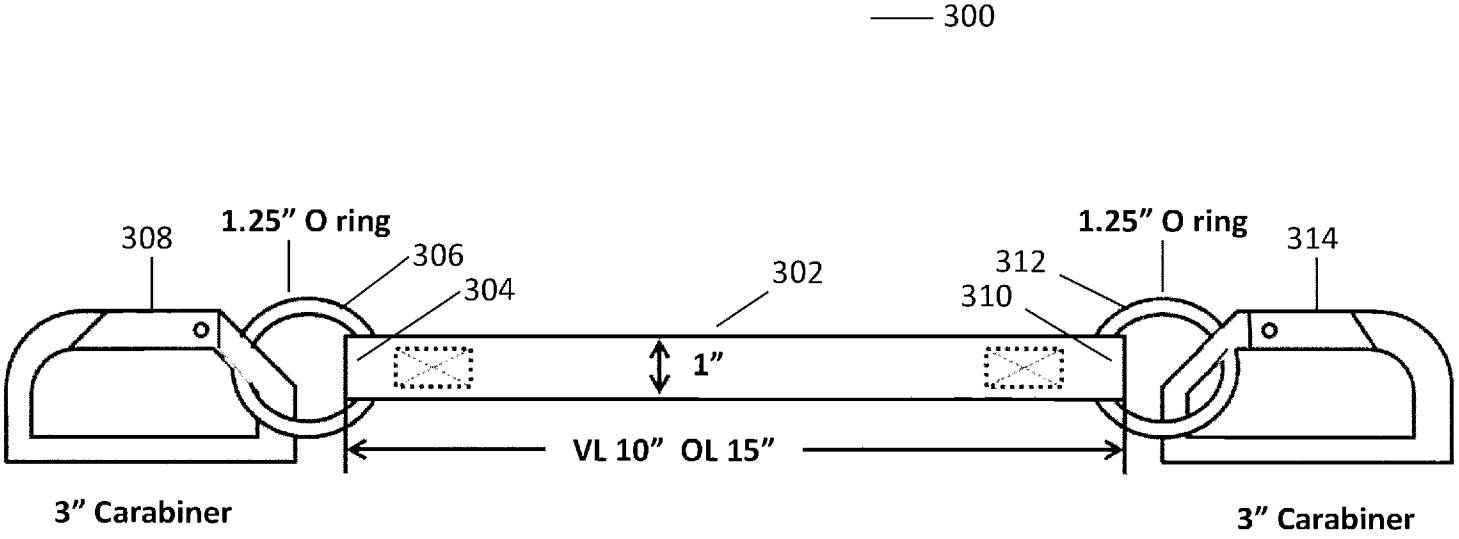
FIG. 10 is a plane view of an extension strap.

When Ring 29 or 63 is pulled posteriorly, inferiorly, or superiorly it will create an extension force in the sagittal plane. The body will resist with a flexion force. The involvement of lower body musculature will depend on if the exerciser is seated, standing, walking or running. Muscles involved with trunk flexion:

Internal Oblique
Pyramidalis
Transvese Abdominis
Psoas major and minor
External Oblique
Rectus Abdominus When the strap in FIG. 10 is pulled anteriorly, inferiorly, or superiorly it will create a flexion force in the sagittal plane. The body will resist with an extension force. The involvement of lower body musculature will depend on if the exerciser is seated, standing, walking or running. Muscles involved with trunk extension:

Serratus Posterior—Superior/Inferior
Multifidus Lumborum
Multifidus Thoracis
Rotatores Lumborum
Rotatores Thoracis
Semispinalis Throacic
Quadratus Lumborum
Iliocostalis Lumborum
Iliocostalis Thoracis
Longissimus Lumborum
Longissimus Thoracis
Latissimus dorsi
Internal Oblique
External Oblique
Interspinalis
Intertranversarii Muscles of the lower body involved with stabilization of the pelvis are the same as those listed under Ring 65, 67/Strap 60-70—Anterior.

Muscles of the lower body involved with stabilization of the pelvis are the same as those listed under Ring 65, 67/Strap 60, 70—Anterior.

Posteriorly pulled, the body will resist with hip flexion, knee flexion, dorsiflexion, hip extension, knee extension, and plantarflexion depending on if the exerciser is seated, standing, walking or running. Muscles used are the same as Ring 65, 67/Strap 60, 70—Posterior Muscles of the lower body involved to stabilize pelvic motions to allow trunk musculature to resist with rotational and/or flexion force when standing, seated, walking or running. The body will also indirectly resist with trunk flexion. Muscles involved are the Internal Oblique, Pyramidalis, Transverse Abdominis, Psoas major and minor, External Oblique and Rectus Abdominus.

Laterally pulled. The body will resist with hip adduction, hip abduction, hip extension, knee extension, and plantarflexion. Muscles used are the same as Ring 65, 67/Strap 60, 70 A'—Posterior Muscles of the lower body involved to stabilize pelvic motions to allow trunk musculature to resist with rotational and/or flexion force when standing, seated, walking or running. The body will also indirectly resist with lateral flexion of the trunk. Muscles used are the same as Ring 65, 67/Strap 60, 70—Superior for muscles involved with lateral trunk flexion.

Anteriorly pulled. The body will resist with hip extension, knee extension, plantarflexion, hip flexion, knee flexion, and dorsiflexion, depending on if the exerciser is seated, standing, walking or running. Muscles involved are the same as Ring 65, 67/Strap 60, 70—Posterior, Muscles of the lower body involved to stabilize pelvic motions to allow trunk musculature to resist with rotational and/or flexion force when standing, seated, walking or running.

The body will also indirectly resist with trunk extension. Muscles involved are the same as those used with Ring F/Strap F: Anterior, Inferior, Superior involve with trunk extension.

Referring to FIGS. 5-9, depicted is a heavy duty harness embodiment wherein connecting pull rings are employed versus buckles. In this embodiment, resistance harness 100 is formed by a right vertical strap 102 spaced apart from a left vertical strap 104 a lower horizontally disposed straps 106 and 108 and upper horizontally disposed straps 136 and 138. A lower end 110 of vertical strap 102 is coupled to a first lower junction o-ring 112. Similarly vertical strap 104 has a lower end 114 coupled to a second lower junction o-ring 116. A first end 118 of lower intermediate horizontally disposed strap 106 is coupled to the first lower junction o-ring 112. A first end 120 of lower intermediate horizontally disposed strap 108 is coupled to the second lower junction o-ring 116. An adjustable buckle 122 secures the horizontally disposed straps 106 and 108 together.

An upper end 140 of vertical strap 102 is coupled to a first upper junction o-ring 142. Similarly vertical strap 104 has an upper end 144 coupled to a second upper junction o-ring 146. A first end 148 of upper intermediate horizontally disposed strap 136 is coupled to the first upper junction o-ring 142 and a first end 150 of upper intermediate horizontally disposed strap 138 is coupled to the second upper junction o-ring 146. An adjustable buckle 152 secures the horizontally disposed straps 136 and 138 together.

Waist strap 154 extends around the torso of an individual having a first end 156 securing to connecting junction o-ring 116 and second end 158 terminating on junction o-ring 160. The junction o-ring 160 connects to a first end 162 of rear waist strap 164. Rear waist strap 164 has a second end 166 that terminates and connects to junction o-ring 168. Junction o-ring 168 connects to first end 170 of strap 172 which continues around to the front where a second end 174 terminates and connects to junction o-ring 112. Waist strap 154 having a front pull ring 176 depicted near the junction o-ring 116. Waist strap 164 has a rear pull ring 178 positioned between junction o-rings 160 and 168. Waist strap 172 having a front pull ring 180 depicted near the junction o-ring 112.

A second waist strap 182 extends around the torso of an individual having a first end 184 securing to connecting junction o-ring 146 and second end 186 terminating on junction o-ring 190. The junction o-ring 190 connects to a first end 192 of rear waist strap 194. Rear waist strap 194 has a second end 196 that terminates and connects to junction o-ring 198. Junction o-ring 198 connects to first end 200 of strap 202 which continues around to the front where a second end 204 terminates and connects to junction o-ring 142. Waist strap 182 having a front pull ring 206 depicted near the junction o-ring 146. Waist strap 194 has a rear pull ring 208 positioned between junction o-rings 190 and 198. Waist strap 202 having a front pull ring 210 depicted near the junction o-ring 142.

A first shoulder strap 212 extends vertically from a first end 214 secured to junction o-ring 146 and terminates posteriorly with an end 216 of the strap secured to junction o-ring 190. Front junction o-ring 146 connects inferiorly to strap 104 and to upper tie straps 138 and 182 horizontally. Strap 104 continues down to attach to junction o-ring 116. First shoulder strap 212 includes a frontal pull ring 213. Vertical tie strap 230 has a first end 232 secured to junction o-ring 190 and a second end 234 secured to junction o-ring 160, the vertical tie strap 230 of a predetermined length to maintain the horizontal strap 164 from horizontal strap 194 and horizontal side strap 182 from horizontal side strap 152. Vertical tie straps 230 and 236 provide a predetermined spacing between straps (194,164), (182, 154), and (202, 174).

A second shoulder strap 220 extends vertically from a first end 222 secured to junction o-ring 142 and terminates posteriorly with an end 224 secured to junction o-ring 198. Front junction o-ring 142 connects inferiorly to strap 102 and to upper tie straps 148 and 202 horizontally. Strap 102 continues down to attach to junction o-ring 112. Junction o-ring 198 attaches horizontally to upper tie strap 194 and upper side strap 202. Second shoulder strap 220 includes a frontal pull ring 221. Vertical tie strap 236 has a first end 238 secured to junction o-ring 198 and a second end 240 secured to junction o-ring 168, the vertical tie strap 236 of a predetermined length to maintain the horizontal strap 164 from horizontal strap 194 and horizontal side strap 202 from horizontal side strap 172.

Resistance Belt only, wherein the lower level of the harness can be uncoupled from the shoulder harness portion to enable the lower level to be used as a resistance belt. When pulled in any direction, the resistance belt will not have any direct force going through the trunk or shoulder girdle. The belt will be placed around the hips and will only directly engage the lower body. The trunk will indirectly be affected due to the need to stabilize the spine and/or pelvis in order for the lower body to resist the pull of the belt. Each ring does not need to be used in order to change the direction of force. If the belt is loosened, only one ring needs to be attached to a resistance and the whole belt will slide around the body to provide variations in the direction of force. The exerciser is usually standing, walking or running when using as a belt only.

FIG. 10 is an extension strap 300 assembly that can be attached to the junction o-rings in the front of the harness to add missing degrees of resistance capability. The extending strap comprises a joinder strap 302 having a first end 304 secured to a junction o-ring 306 with a quick attachment/release provided by a carabiner 308. A second end 310 secured to a junction o-ring 312 with a quick attachment/release provided by a carabiner 314.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art, which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A resistance harness comprising:

first and second vertical support straps each having a fixed length and spaced apart by upper and lower intermediate horizontally disposed straps having an adjustable snap therebetween;

a first waist strap extending from an end of said upper horizontally disposed strap and configured to extend around the torso of an individual and terminating on an opposite end of said upper horizontally disposed strap, at least two front upper pull rings slidably positioned along said first waist strap and each said pull ring movable along said first waist strap between an anterior position and a posterior position;

a second waist strap extending from an end of said lower horizontally disposed strap and configured to extend around the torso of the individual and terminating on an opposite end of said lower horizontally disposed strap, at least two front lower pull rings slidably positioned along said second waist strap and movable along said second waist strap between an anterior position and a posterior position;

a first shoulder strap having a first end coupled to said first vertical support, said first vertical support strap configured to extend over a shoulder torso of the individual and securing said first and second horizontal straps in a spaced apart position along the back of the torso;

a second shoulder strap having a first end coupled to said second vertical support, said second vertical support strap configured to extend over a shoulder torso of the individual and securing said first and second horizontal straps in a spaced apart position along the back of the torso;

a first shoulder strap front pull ring slidably along said first shoulder strap, a second shoulder strap front pull ring slidably along said second shoulder strap;

a rear upper pull ring attached to said first waist strap and movable along a posterior position between said first and second shoulder strap;

a rear lower pull ring attached to said second waist strap and movable along a posterior position between said first and second shoulder strap;

wherein said harness is configured to be secured to the torso of an individual and said pull rings are constructed and arranged to slide from anterior to posterior or medial to lateral whereby said pull rings are used to enable concentric, eccentric, or isometric resistance.

2. The resistance harness according to claim 1 wherein each said adjustable snap positioned with each said upper or lower tie is constructed and arranged to allow case of strap length adjustment from either end of said snap to allow central positioning of said snap between said first and second vertical support straps.

3. The resistance harness according to claim 1 wherein said shoulder straps and said upper and lower straps are secured together by attachment threading.

4. The resistance harness according to claim 1 wherein said shoulder straps and said upper and lower straps are secured together by junction o-rings.

5. The resistance harness according to claim 4 including an extension strap securable to two junction o-rings, said extension strap formed from a joinder strap having a first end carabiner and a second end carabiner.

* * * * *